United States Patent [19]

Yan

[11] Patent Number: 4,792,750

[45] Date of Patent: Dec. 20, 1988

[54] RESISTORLESS, PRECISION CURRENT SOURCE

[75] Inventor: Raymond C. Yan, Daly City, Calif.

[73] Assignee: Teledyne Industries, Inc., Mountain View, Calif.

[21] Appl. No.: 37,867

[22] Filed: Apr. 13, 1987

[51] Int. Cl.[4] ..... G05F 3/16

[52] U.S. Cl. ..... 323/315

[58] Field of Search ..... 323/315, 316, 317

[56] References Cited

U.S. PATENT DOCUMENTS

| | | | |
|---|---|---|---|
| 4,029,974 | 6/1977 | Brokaw | 323/315 |
| 4,166,971 | 9/1979 | Schneider | 323/315 |
| 4,287,439 | 9/1981 | Leuschner | 323/314 |
| 4,302,718 | 11/1981 | Schade | 323/315 |
| 4,697,154 | 9/1987 | Kousaka et al. | 323/315 |

*Primary Examiner*—Patrick R. Salce
*Assistant Examiner*—J. Sterrett
*Attorney, Agent, or Firm*—Fliesler, Dubb, Meyer & Lovejoy

[57] ABSTRACT

The present invention provides a precision current source wherein a reference current level is established by the inter-dependent operation of three current stages. The first stage provides first and second current paths and functions to mirror the current level through the first and second current paths. A second stage, coupled to the first and second current paths, defines a first current/voltage relationship at respective points in the first and second current paths. A third stage, also coupled to the first and second current paths, defines a second current/voltage relationship again at the respective points in the first and second current paths. In accordance with the present invention, the first and second current/voltage relationships are chosen to be mutually solvable for a discrete, non-zero pairing of voltage and current levels, thereby establishing a reference current level at the defined current set point.

24 Claims, 2 Drawing Sheets

RESISTORLESS, PRECISION CURRENT SOURCE

FIELD OF INVENTION

The present invention is generally related to precision current sources, sinks, amplifiers, mirrors and other similar analog circuits that operate to provide a precise current reference. In particular, the present invention is related to a precision current source of monolithic construction that employs a resistorless design to achieve precision operation independent of fabrication process and operating temperature variations within a wide range of source voltages, including voltages below six volts.

BACKGROUND OF THE INVENTION

The class of analog circuits conventionally referred to as current sources typically includes current sources, sinks and current mirror amplifiers. Current sources are most commonly used to provide a reference current flow that serves as the basis for current driving other analog circuits.

In a simple current source of conventional design, a resistor is used to set the reference current level through one leg of a current mirror configured pair of transistors. While the appeal of such a simple circuit is obvious, and indeed, the circuit is more than adequate as a current source in many applications, the presence of the resistor essentially precludes its possible operation as a precision current source. Although the distinction between precision and ordinary current source designs is rather empirical, a precision current source is generally regarded as one whose reference current changes by less the 5000 parts per million (ppm) per degree centigrade over its specified operating temperature range. Current sources utilizing resistors typically fail to qualify as precision current sources due to the substantially temperature dependent value of their resistors. The value of a P-type resistor fabricated in a monolithic substrate will often vary by one or more percent per degree centigrade.

A somewhat related drawback to utilizing resistor-based current source designs, particularly in monolithically fabricated analog circuits, is the wide variance in resistive values realized as a result of normal fabrication process variation. Often there is a desire to be able to produce analog circuits of common design with closely matched operating characteristics. Expected, but difficult to eliminate, parameter fluctuations between processing runs of a monolithic analog circuit typically show up as significant variations in the value of the resistors formed. Consequently, the reference current-levels between circuits of identical design or both will vary unpredictably when separately fabricated in different processing runs or on different substrates, or both.

An alternative to current sources employing resistors is achieved with current source designs utilizing a series connected field effect transistor (FET) and a Zener diode voltage reference. The FET is placed in the primary leg of a current mirror and the Zener diode placed so as to be reversed biased in the second leg of the current leg. The gate of the FET is coupled to the base of the Zener diode. Consequently, the break-over voltage threshold of the Zener diode and the particular selected gate/source voltage-to-channel current relationship of the FET functions to constrain the level of current flow through the primary current mirror leg.

Zener diode design current sources have the advantage of not employing a true resistor. The temperature dependent characteristics of the resistively operated FET are such that precision operation of the current source is readily obtainable. However, the break-over voltage of the Zener diode is itself fairly temperature sensitive and highly dependent on fabrication parameters. Further, the required usage of a Zener diode alone places a substantial practical limitation on the usage of Zener diode type current sources in circuits of monolithic implementation. Zener diodes are difficult to fabricate with break-over voltages of less than 6.2 volts on a monolithic substrate in common with other active devices due to the very high impurity doping densities required. Consequently, regulated operation of the current source is generally not possible at source voltages of less than about 6 volts.

SUMMARY OF THE INVENTION

Therefore, a purpose of the present invention is to provide a precision current source that is operable over a wide range of supply voltages including voltages below 6 volts.

The present invention provides a precision current source wherein a reference current level is established by the inter-dependent operation of three current stages. The first stage provides first and second current paths and functions to proportionally mirror a current level through the first and second current paths. A second stage, coupled to the first and second current paths, defines a first current/voltage relationship at respective points in the first and second current paths. A third stage, also coupled to the first and second current paths, defines a second current/voltage relationship again at the respective points in the first and second current paths. In accordance with the present invention, the first and second current/voltage relationships are chosen to be mutually solvable for a discrete, non-zero pairing of voltage and current levels, thereby establishing a reference current level at the mutual relationship defined current set-point.

Thus, an advantage of the present invention is that it provides a current source design that is resistorless and without reliance on the use of a Zener diode. Consequently, the current source of the present invention readily achieves precision operating characteristics extending uniformly over a operating source potential difference range of approximately 2.5 to over 20 volts.

Another advantage of the present invention is that the current set point is generally insensitive to process variations between monolithic fabrication manufacturing runs or as a result of fabrication on separate substrates. The current set-point is a product of the relative active device parameters of a fabricated monolithic circuit embodying the present invention rather than any absolute fabricated value, such as that of a resistor or the break-over threshold voltage or a Zener diode.

A further advantage of the present invention is that the current source may be readily fabricated on a monolithic substrate in conjunction with the simultaneous fabrication of other active analog circuits or circuit components including complimentary metal oxide semiconductor (CMOS) FETs.

A still further advantage of the present invention is that it possesses a simple design that introduces no significant fabrication or usage complexities into the design of a monolithic analog device by virtue of its presence.

BRIEF DESCRIPTION OF THE DRAWINGS

These and other attendant advantages of the present invention will become appreciated as the same becomes better understood by reference to the following detailed description of the invention when considered in conjunction with the accompanying drawings, wherein like reference numerals designate like parts throughout the figures thereof, and wherein.

DETAILED DESCRIPTION OF THE INVENTION

Figure 1:
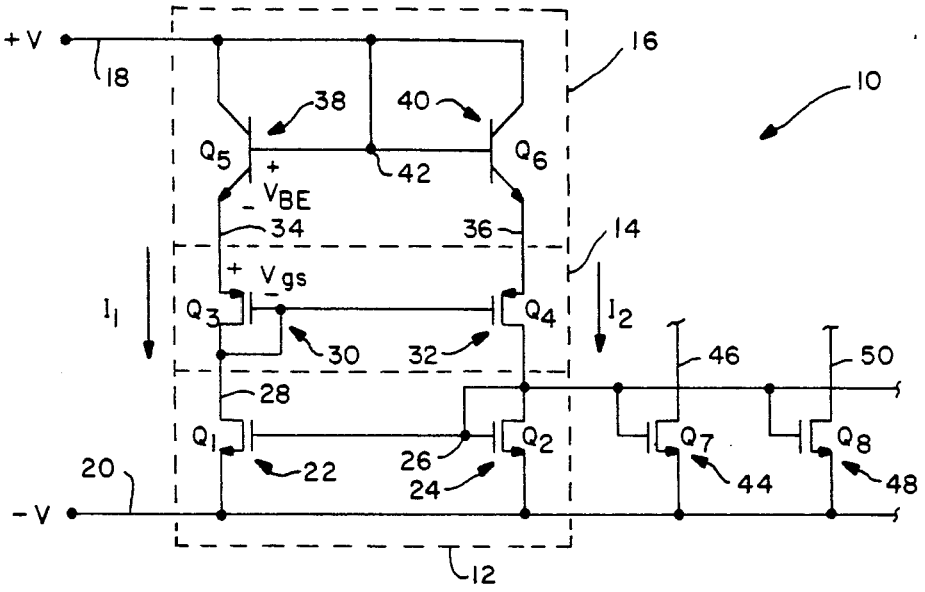
FIG. 1 is a circuit schematic of a preferred precision current source of the present invention.

Referring to FIG. 1, a precision current source, generally indicated by the reference numeral 10 and representing a preferred embodiment of the present invention, is shown. The current source 10, as shown, is capable of operating between +V and −V source voltages applied at terminals 18, 20 with a potential difference in the range about 2.5 to 20 volts. The current source 10 establishes two current paths between the source voltage terminals 18, 20. These two paths are generally indicated by the arrows $I_1$ and $I_2$. In this preferred embodiment of the present invention, the current source 10 includes a current mirror stage 12, a source follower stage 14 and an emitter follower stage 16 and any number of reference current driver (as shown, current-sink configured) transistors 44, 48. The current mirror stage 12 includes a pair of N-channel FETs 22, 24 whose source terminals are commonly connected to the −V source terminal 20. The gate terminals of the transistors 22, 24 are coupled in common to the drain terminal of the transistor 24. The width (W) and length (L) dimensions of the channel regions of the transistors 22, 24 are preferably chosen to be the same to minimize the impact of any sizing mismatch on precision operation. Alternately, the ratio of the transistor dimensions may be varied from a value of one by a scaling factor "$\gamma$". The gate to source voltage potential, $V_{gs}$, of the transistor 24 directly depends on the magnitude of the current flow $I_2$. The gate voltage thus applied to transistor 22 forces the magnitude of the current $I_1$ through transistor 22 such that $I_1=\gamma I_2$.

The source follower stage 14 and emitter follower stage 16 operate inter-dependently to establish a current set-point for the parallel currents $I_1$ and $I_2$. The source follower stage 14 includes a P-channel FET 30 whose drain terminal 28 is connected to the drain terminal of current mirror transistor 22 and a second P-channel FET 32 whose drain terminal is connected to the drain and base terminals 26 of the current mirror transistor 24. The gate contacts of the transistors 30, 32 are commonly connected to the drain terminal 28 of the transistor 30 to complete the source follower stage 14. In the preferred embodiment of the present invention, the active channel region width-to-length ratio of transistor 32 differs from that of transistor 30 by a factor of "1/n", where "n" is a positive number greater than $\gamma$. Since the current relationship $I_1=\gamma I_2$ is established by the current mirror stage 12, the difference in width-to-length ratios of the transistors 30, 32 is reflected in a difference in the gate to source voltages of the transistors 30, 32 at their source terminals 34, 36. That is, the difference in current densities forced by the fixed relation $I_1=\gamma I_2$ and the difference in channel dimensions forces a proportional difference in the gate-to-source voltages of the transistors 34, 36. The inter-dependence of the ratio of width-to-length, the currents $I_1$ and $I_2$, and the gate-to-source voltages of the transistors 20, 32 defines the source follower stage 14 voltage/current relationship.

The emitter follower stage 16 includes 2 bipolar NPN transistors 38, 40 diode connected to the +V source terminal 18. The emitters of the transistors 38, 40 are respectively connected to the source terminals 34, 36 of the source follower stage 14 transistors 30, 32. In accordance with the present invention, the emitter area of the transistor 40 is a factor "m" greater than that of the transistor 38, where "m" is again a positive value greater than one. Given again that the magnitude of the currents $I_1$ and $I_2$ are set by the current mirror stage 12, the factor "m" difference in emitter area, and therefore the current density through the emitters, is reflected by the transistors 38, 40 as a difference in the base-to-emitter voltage between the two transistors 38, 40. The inter-dependence of the active area scaling factor "m", the currents $I_1$ and $I_2$, and the base-to-emitter voltages of the transistors 38, 40 defines the emitter follower stage 16 voltage/current relationship.

Figure 2:
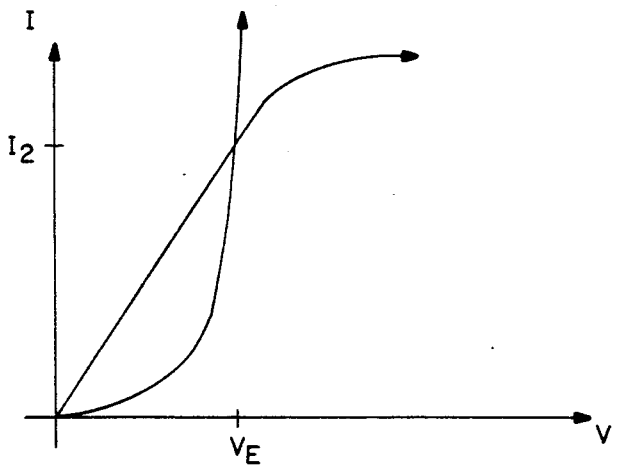
FIG. 2 is a graphic illustration of the paired current-/voltage relationships utilized to establish a current set point in accordance with the present invention.

Referring now to FIG. 2, the first quadrant current-/voltage (IV) relationships defined by ideal FET 32 and bipolar 40 transistors of the source follower and emitter follower stages 14, 16 are shown. The fundamental difference in the current/voltage relationships shown arises from the fact the source follower stage 14 utilizes a FET device while the emitter follower stage 16 utilizes a bipolar device. In accordance with the present invention, the selection of the scaling factors "$\gamma$", "1/n" and "m" will define a discrete non-zero value of the current $I_2$ where the $\Delta V_{be}$ of the emitter follower stage 16 equals the $\Delta V_{gs}$ of the source follower stage 14. That is, though the current mirror stage 12 forces $I_1=\gamma I_2$, it is the relative current/voltage relationships of the transistors of the source follower and emitter follower stages 14, 16 that establish the magnitude of the currents $I_1$, $I_2$ based on the values of "m" and "1/n". Additionally, the fact that the temperature coefficients of the P-channel FETs and NPN bipolar transistors are of complementary polarity inherently tends to minimize changes in the current set-point due to temperature induced variations in the current density verses gate-to-source and base-to-emitter voltage drop characteristics of the transistors.

In greater detail, the loop equation for the loop defined by transistors 30, 32, 40 and 38 of FIG. 1 (for $\gamma=1$) is given by Equation 1:

$$V_{be1} + V_{Tp1} + \left[\frac{2I}{\beta\left(\frac{W}{L}\right)_p}\right]^{.5} = \qquad \text{Eq. 1}$$

-continued $$V_{be2} + V_{Tp2} + \left[\frac{2I}{\beta\left(\frac{W}{L}\right)_p\left(\frac{1}{n}\right)}\right]^{.5}$$

where the $V_{be1}$ and $V_{be2}$ are the base to emitter voltages of transistors 38 and 40, $V_{Tp1}$ and $V_{Tp2}$ are the threshold voltages of the P-channel transistors 30 and 32, "I" is the magnitude of the currents $I_1=I_2$, and $\beta=\mu C_{ox}$ is the gain factor of the FET transistors 30 and 32.

$$(V_{Tp2} - V_{Tp1} + V_{be2} - V_{be1}) + (n^{.5} - 1)\left[\frac{2I}{\beta\left(\frac{W}{L}\right)}\right]^{.5} = 0 \quad \text{Eq. 2}$$

or more simply:

$$-\Delta V_{Tp} - \Delta V_{be} + \Delta V_{gs} = 0 \quad \text{Eq. 3}$$

where $\Delta V_{be}=(V_{be1}-V_{be2})$, $\Delta V_{Tp}=(V_{Tp1}-V_{Tp2})$, and $\Delta V_{gs}=(V_{gs32}-V_{gs30})$.

The value of $\Delta V_{be}$ can be determined from the standard bipolar transistor current/voltage relationship given by Equation 4:

$$I = I_s e^{\left(\frac{V_{be}}{kT/q} - 1\right)} \quad \text{Eq. 4}$$

where $I_s$ the saturation current of the bipolar transistor. Solving for the base to emitter voltage, $V_{be}$, yields Equation 5:

$$V_{be}=(kT/q)\mathrm{Ln}(I/I_s) \quad \text{Eq. 5}$$

Therefore, the difference in the base to emitter voltage of the bipolar transistor 38 with respect to that of the bipolar transistor 40 is given by Equations 6 and 7:

$$\Delta V_{be} = \frac{kT}{q}\left(\mathrm{Ln}\frac{I}{I_s} - \mathrm{Ln}\frac{I}{mI_s}\right) \quad \text{Eq. 6}$$

$$\Delta V_{be} = \frac{kT}{q}(\mathrm{Ln}(m)) \quad \text{Eq. 7}$$

Substituting $\Delta V_{be}$ into Equation 2 yields Equation 8:

$$-\Delta V_{TP} - \frac{kT}{q}(\mathrm{Ln}(m)) + (n^{.5} - 1)\left[\frac{2I}{\beta\left(\frac{W}{L}\right)_p}\right]^{.5} = 0 \quad \text{Eq. 8}$$

where the scaling values "n" and "m" are both greater than one. Solving Equation 8 for current ultimately yields Equation 11:

$$-\Delta V_{TP} + \frac{kT}{q}\mathrm{Ln}\left(\frac{1}{m}\right) + (n^{.5} - 1)\left[\frac{2I}{\beta\left(\frac{W}{L}\right)}\right]^{.5} = 0 \quad \text{Eq. 9}$$

$$\left(\frac{kT}{q}\mathrm{Ln}(m) + \Delta V_{Tp}\right) = (n^{.5} - 1)\left[\frac{2I}{\beta\left(\frac{W}{L}\right)}\right]^{.5} \quad \text{Eq. 10}$$

$$I = \frac{\beta}{2}\left(\frac{W}{L}\right)_p\left(\frac{\left(\frac{kT}{q}\right)\mathrm{Ln}(m) + \Delta V_{Tp}}{n^{.5} - 1}\right)^2 \quad \text{Eq. 11}$$

Without the assumption that $\gamma=1$, Equation 11 becomes:

$$I = \frac{\beta}{2}\left(\frac{W}{L}\right)_p\left(\frac{\left(\frac{kT}{q}\right)\mathrm{Ln}(\gamma m) + \Delta V_{Tp}}{n^{.5} - \gamma^{.5}}\right) \quad \text{Eq. 12}$$

As can be seen from Equations 11 and 12, any pairing of the values of "n" and "m" ("m" greater than 1; "n" greater than "$\gamma$") for a value "$\gamma$" will correspond to a discrete value of the current I. The values of "$\gamma$", "m" and "n" can therefore be chosen to define a desired current set point for the current sink 10.

Referring again to the graph of FIG. 2, and considering that the device current/voltage relationships for the bipolar and FET transistors 40, 32 may not be ideal, a second current set point will likely occur at or near a current value of zero. The value of such a near-zero current set point will also be dependent on the paired values of "m" and "n" and the value of "$\gamma$". Operation of the current source 10 at such an undesired current set point may be avoided by appropriately manufacturing or otherwise biasing the transistors 30, 32, 38, 40 such that this undesired current set point occurs in the second, third or fourth quadrants of the mutual current-/voltage relationships defined by the transistors 30, 32, 38, 40.

Figure 3:
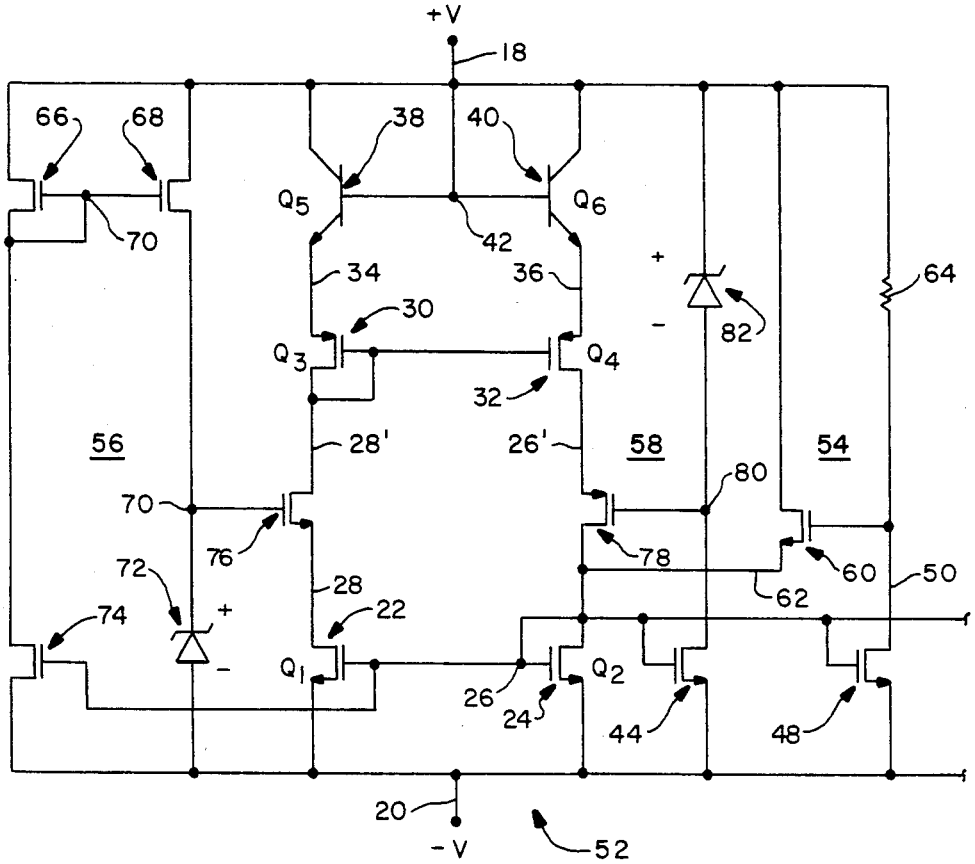
FIG. 3 is a circuit schematic of a precision current source of the present invention including bootstrap and high source voltage limiting circuit additions.
Figure 4:
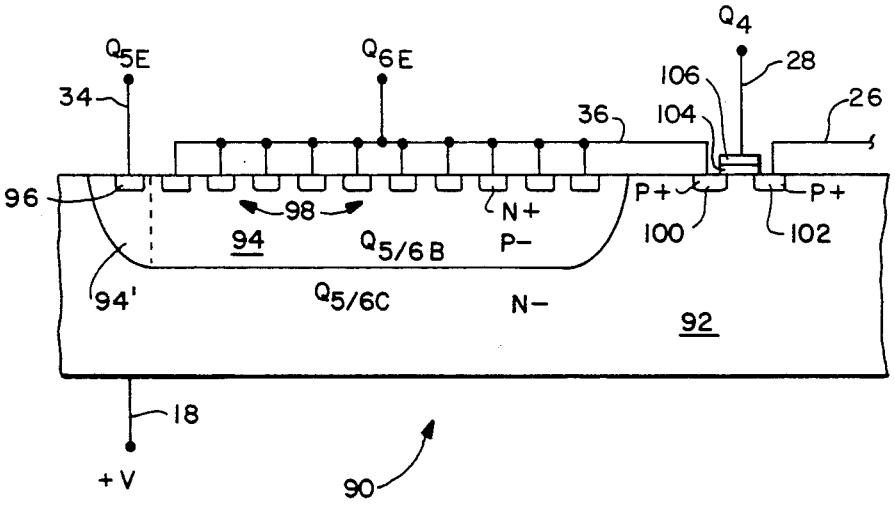
FIG. 4 is a cross-sectional view of the preferred fabrication detail of the bipolar transistor stage of a preferred embodiment of the present invention.

Referring now to FIG. 3, an alternate embodiment of the present invention, modified to ensure proper current set point operation and a higher degree of precision operation at high source voltage potential differences, is shown. The current source, generally indicated by the reference numeral 52, includes a power-on boot-strap circuit, generally indicated by the reference numeral 54. The boot-strap circuit 54 includes a FET 60 whose drain gate and source are connected to the +V source terminal 18, through a resistor 64 to the +V source terminal 18 and to the commonly connected gate/drain of the current source transistor 24, respectively. The drain terminal 50 of the current sink configured transistor 48 is also connected to the gate of the FET 60.

In operation, the boot-strap circuit 54 insures that a non-zero current is passed by the transistor 24 beginning with the application of the +V source potential to the current source 52. A zero-reference current implies that the current sink configured transistor 48 will be off allowing the FET 60 to be turned on as a consequence of the resistive pull up of its gate to the +V source potential. The current passed through the FET 60 is forced through transistor 24. Consequently, the reference current through the current mirror stage 12, and therefore the current source 52, will quickly snap to the current value required for the $\Delta V_{be}$ of transistors 38, 40 to match the $\Delta V_{gs}$ of transistors 30, 32. The value of the resistor 64 is chosen such that the reference current drawn by the current sink transistor 48 is sufficient to completely turn off FET 60.

The supplementary circuitry generally indicated by the reference numerals 56, 58 is utilized to minimize loss of precision in the operation of the current sink 52 at high source voltage potential differences due to a channel length modulation effect in transistors 22 and 32. Briefly considering again the current source 10 of FIG. 1, the drain voltage potential of transistor 22 will increase as the source voltage potential is increased. This results in from the increase in current through transistor 22 its finite output impedance. The transistor 24 is not significantly affected due to its common drain to gate connection. Therefore, there will be an increasing mismatch in the current $I_1$ and $I_2$ through the transistors 22, 24 with increases in the source voltage potential difference.

The addition of a transistor 76 serially connected between transistors 30 and 32 clamps the voltage potential at the drain of transistor 22 at a maximum value controlled by the break-over voltage of a Zener diode 72 connected between the gate terminal 70 of the transistor 76 and the $-V$ source voltage potential 20. In the preferred embodiment of the current source 52, the current through the Zener diode 72 is precisely regulated by reflecting the reference current of the current source 52 through a current mirror formed by transistor 66, 68 as established by the current sink configured transistor 74. That is, given that the current sink transistor 74 is generally identical to the current mirror transistors 22, 24, the current sink configured transistor 74 will draw current equal to the reference current through the first leg of the current mirror formed by the transistor 66, 68. A mirrored current equal to the reference current is therefore passed through the transistor 68 to the gate of the clamping transistor 76 and through the Zener diode 72.

In operation, the voltage potential at the gate 70 of the clamping transistor 76 will rise with increasing source voltage potential until the Zener break-over voltage is reached. Thereafter, the gate voltage of the clamp transistor 76 and the drain voltage of the transistor 22 are clamped at the values of $V_z$ and $V_z-V_{gs}$, respectively. In the preferred embodiment of the current source 52, the break-over voltage of the Zener diode 72 is 6.2 volts. Lower Zener break-over voltages are not generally needed since the occurrence of channel width modulation in transistor 22 is negligible for source to drain voltage potentials of less than 6.2 volts $-V_{gs}$ of transistor 76.

The clamp circuit 50 performs essentially the same function as the clamp circuit 56. However, the clamping function is performed with respect to the drain to source voltage, $V_{DS}$, of the transistor 32. A clamping transistor 78 is provided in series between the transistors 24 and 32. The gate of the clamp transistor 78 is connected through a Zener diode 78 to the source voltage potential and to the drain of a current sink configured transistor 44. Assuming that the current sink configured transistor 44 is essentially identical to the current source mirror transistors 22, 24, the current sink configured transistor 44 will try to sink a current equivalent to the reference current serially through the Zener diode 82. For all source potential voltages less than about the break-over voltage of the Zener diode 82, the clamp transistor 78 will remain on (i.e., conductive). As the source voltage increases further, Zener diode 82 will conduct a current equal to the reference current and the gate voltage potential of the clamp transistor 78 will rise to the $+V$ source potential less the break-over voltage $V_z$ of the Zener diode 82. Therefore, the drain voltage potential of the transistor 32 is clamped at a value of $+V-V_z$ plus the $V_{gs}$ of the clamp transistor 78. In the preferred embodiment of the current source 52, the break-over voltage $V_z$ of the Zener diode 82 is 6.2 volts. Thus, the change in current through the transistor 32 as a consequence of channel length modulation with increasing source voltages is limited to a negligible value.

The insensitivity of the present invention to fabrication related variations in the development of the reference current "I" can be readily demonstrated by considering the impact on the current "I" described by Equation 11 due to a change in the parameters of significance. Equations 13–16 relate variance in the current "I" (assuming "$\gamma$"=1) to variances in the P-channel FET channel scaling factor "n", the voltage threshold of the P-channel FETs, the voltage threshold of the N-channel FETs, the N-channel width-to-length ratio, and the bipolar transistor active emitter area scaling factor "m".

$$\frac{\Delta n}{n} : \frac{\Delta I}{I} = \frac{\Delta n}{n}\left(\frac{n^{.5}}{n^{.5}-1}\right) \qquad \text{Eq. 13}$$

$$\Delta V_{Tp}: \frac{\Delta I}{I} = \frac{2\Delta(V_{Tp1}-V_{Tp2})}{\frac{KT}{q}\,\mathrm{Ln}(m) + (V_{Tp1}-V_{Tp2})} \qquad \text{Eq. 14}$$

$$\Delta V_{Tn}: \frac{\Delta I}{I} = \left(\frac{\Delta\left(\frac{W}{L}\right)N}{\left(\frac{W}{L}\right)N} + \frac{2\Delta V_{Tn}}{V_{gsN}-V_{Tn}}\right) * \left(\frac{1}{\sqrt{n}-1} + \frac{2}{\mathrm{Ln}(m)}\right) \qquad \text{Eq. 15}$$

$$\frac{\Delta m}{m} : \frac{\Delta I}{I} = \frac{\Delta m}{m}\left(\frac{2}{\mathrm{Ln}(m)}\right) \qquad \text{Eq. 16}$$

Equations 13 and 15 indicate that large values are preferred for the scaling factors "n", and "m". Equations 14 and 15 illustrate that the present invention is relatively insensitive to small FET threshold shifts. Finally, Equation 16 indicates that the present invention is also fairly insensitive to mismatch of the bipolar transistors. However, mismatch in the width-to-length ratios of the current mirror transistors will be amplified as a consequence of the source and emitter follower stages operating as current amplifiers. Therefore, it is preferable in the present invention to choose the width-to-length ratios of the current mirror transistors such that $I_1$ equals $I_2$.

The change in the current I with respect to temperature variations can also be determined from Equation 11. Taking the derivative of the current I with respect to temperature yields:

$$\frac{dI}{dT} = \left(\frac{(\mathrm{Ln}(m))^2}{(m^{.5}-1)^2}\left(\frac{W}{L}\right)\right)\left(2V_T\frac{dV_T}{dT}\beta + V_T^2\frac{d\beta}{dT}\right) \quad \text{Eq. 17}$$

$$= \left(\frac{(\mathrm{Ln}(m))^2}{(m^{.5}-1)^2}\left(\frac{W}{L}\right)\right)(V_T^2\,\beta)\left(\frac{2}{V_T}\ \frac{dV_T}{dT} + \frac{1}{\beta}\ \frac{d\beta}{dT}\right) \quad \text{Eq. 18}$$

$$= \frac{2\,dV_t}{V_T\,dT} + \frac{1}{\beta}\ \frac{d\beta}{dT} \quad \text{Eq. 19}$$

Therefore, the temperature coefficient of the present invention can be stated as Equation 20:

$$T_C=(2/T)+(1/\beta)(d\beta/dT) \quad \text{Eq. 20}$$

EXAMPLE

Circuits embodying the present invention has been fabricated and tested. First and second identical arrays of the circuit were fabricated on separate substrates, though processed in the same fabrication run. The circuits fabricated are substantially the same as the embodiment of the present invention shown in FIG. 3. The circuit parameters used are as follows (dimensions are in micrometers):

Scaling Factors:

"m"=100

"n"=2

"γ"=1

Dimensions:

$Q_1(W/L)_n$: (60/15)

$Q_2(W/L)_n$: (60/15)

$Q_3(W/L)_p$: (380/30)

$Q_4(W/L)_p$: (190/30)

Worst case parameter value estimates:

$(\Delta m/m)$: 1%

$(\Delta n/n)$: 1%

$\Delta(V_{TP1}-V_{TP2})$: 5 mV p1 $(V_{TP1}-V_{TP2})$: 25 mV $\Delta V_{TN}$: 5 mV $V_{gs}-V_T$: 0.4 V $\Delta(W/L)_n/(W/L)_n$: 1%

$(\partial\beta/\beta$: −27% (25° to 85° C.)

Computed errors:

| Error source | $\frac{\Delta I}{I}$ | Eq. # |
|---|---|---|
| $\frac{\Delta n}{n}$ | 3.4% | 13 |
| $\Delta V_{TP}$ | 6.9% | 14 |
| $\Delta V_{TN}$ | 10.0% | 15 |
| $\frac{\Delta m}{m}$ | 0.43% | 16 |

Computed operating current set-point:

$$I \simeq 10\ \mu A \quad \text{Eq. 11}$$

$$V_{gsN} = \left(\frac{2I}{\beta\left(\frac{W}{L}\right)N}\right) + V_{TN}$$

$$\simeq 1.0\ V$$

Computed Temperature Coefficient (T=25° to 85° C.):

$$Tc=2211\text{ppm/°C.} \quad \text{Eq. 20}$$

The difference between the mean operating set-point current values measured for circuits fabricated on the two substrates was measured to be about 1.3% typical. The temperature coefficient over an operating temperature range of 25° to 125° C. was measured to be approximately 1800 ppm/°C.

Thus, a precision resistorless current source relying on the mutual inter-dependence of two differing voltage/current relationships represented as two stages of the current source and a third stage current mirror that together establish a precise current set point substantially independent of a supply voltage difference that can vary from approximately 2.5 volts to above 20 volts has been described.

The foregoing disclosure and discussion of the present invention provides a broad teaching of the principles of the present invention such that many modifications and variations of the present invention will be readily apparent to persons of average skill in the art. One such modification is the substitution of PNP for NPN bipolar transistors, P-channel for N-channel transistors and N-channel for P-channel transistors such that the present invention, operating from reversed polarity source potentials, operates in a current source mode rather than as a current sink. It is therefore to be understood that, within the scope of the appended claims, the invention may be practiced otherwise than as specifically described.

I claim:

1. Apparatus for providing a precision reference current level, said apparatus comprising:

(a) first means for providing first and second current paths for the transfer of respective currents, said first means establishing a predetermined relationship between the level of current transferred through said first and second current paths;

(b) second means, coupled to said first and second current paths, for defining a first transistor active area dependant current/voltage drop relationship at respective points in said first and second current paths; and (c) third means, coupled to said first and second current paths, for defining a second transistor active area dependant current density/voltage drop relationship at said respective points in said first and second current paths, wherein said first and second transistor active area dependant current density/voltage drop relationships define a pair of current levels satisfying the predetermined relationship of said first means and the voltage drops of said second and third means are of equal magnitude and opposite relative polarity and wherein said second transistor active area dependant current density/voltage drop relationship is discontinuous with respect to said first current density/voltage drop relationship.

2. The apparatus of claim 1 wherein only discrete pairings of current and voltage levels at said respective points in said first and second current paths mutually satisfy said first and second transistor active area dependant current density/voltage drop relationships and said predetermined relationship of said first means.

3. The apparatus of claim 2 wherein said second means includes first and second transistors of a first type and said third means includes third and fourth transistors of a second type.

4. The apparatus of claim 3 wherein the transistor active areas of said second and fourth transistors are scaled with respect to those of said first and third transistors such that the combined voltage drops of said second and fourth transistors is of equal magnitude to that of said first and third transistors at the current levels of the current transferred through said first and second current paths.

5. The apparatus of claim 4 wherein said first and third transistors are series connected in said first current path and said second and fourth transistors are series connected in said second current path.

6. The apparatus of claim 5 wherein said first and second transistors have a complementary temperature coefficient with respect to that of said third and fourth transistors.

7. The apparatus of claim 6 further comprising means, coupled to said first means, for sourcing current at a level proportional to the current level through said first and second current paths.

8. The apparatus of claim 7 wherein said first and second transistors are field effect transistors and wherein said third and fourth transistors are bipolar transistors.

9. A precision current reference circuit comprising:

(a) a first current mirror providing first and second current paths for the conduction of first and second currents, respectively, said first current mirror establishing a fixed current level relationship between said first and second currents;

(b) a second current mirror including first and second transistors, said first transistor being coupled in series with said first current path and said second transistor being coupled in series with said second current path, said second current mirror defining a first current/voltage relationship arising from a difference in the current density of said first and second currents through said first and second transistors, respectively, to establish a first voltage differential between respective points in said first and second current paths; and (c) a third current mirror including third and fourth transistors, said third transistor being coupled in series with said first current path and said fourth transistor being coupled in series with said second current path, said second current mirror defining a second current/voltage relationship, discontinuous with respect to said first current/voltage relationship, arising from a difference in the current density of said first and second currents through said third and fourth transistors, respectively, said third current mirror establishing a second voltage differential at said respective points in said first and second current paths complementary to said first voltage differential at said respective points.

10. The current reference circuit of claim 9 wherein said first and second current/voltage relationships are mutually satisfied by at least one discrete set of current levels through said first and second current paths and corresponding voltage levels as determined by said first and second current/voltage relationships at said respective points in said first and second current paths.

11. The current reference circuit of claim 10 wherein said first and second transistors are field effect transistors configured as a current mirror amplifier and said third and fourth transistors are bipolar transistors configured as a current mirror amplifier.

12. The current reference circuit of claim 11 wherein the voltage difference between said respective points in said first and second current paths is proportional to the ratio of the channel width to length ratio of said first transistor with respect to that of said second transistor and to the ratio of the active emitter area of said fourth transistor with respect to that of said third transistor.

13. The current reference circuit of claim 12 wherein said first and second transistors have a common temperature coefficient, wherein said third and fourth transistors have a common coefficients complementary with respect to those of said third and fourth transistors.

14. The current reference circuit of claim 13 further comprising means for biasing said current reference circuit to limit the voltage difference across said first current mirror along the respective said first and second current paths.

15. The current reference circuit of claim 14 further comprising a means for forcing an initial current level through said first current mirror.

16. A current level reference coupled between first and second voltage potentials, said source comprising:

(a) a first stage including first and second transistors, said first and second transistors each having first, second and third terminals, said first terminals being coupled to said first voltage potential and said third terminals being coupled to said second terminal of said second transistor;

(b) a second stage including third and fourth transistors, said third and fourth transistors each having respective fourth, fifth and sixth terminals, said fourth terminals being respectively coupled to said second terminals, said sixth terminals being coupled to said fourth terminal of said third transistor;

(c) a third stage including fifth and sixth transistors, said fifth and sixth transistors having respective seventh, eighth and ninth terminals, said seventh terminals being respectively coupled to said fifth terminals of said third and fourth transistors, said eighth and ninth terminals being coupled to said second voltage potential; and wherein said first, second, third and fourth transistors are FETs and said fifth and sixth transistors are bipolar, the channel width-to-length ratio of said first transistor is related to that of said second transistor by a factor "$\gamma$", the channel width-to-length ratio of said third transistor is related to that of said fourth transistor by a factor "1/n", the emitter area of said fifth transistor is related to that of said sixth transistor by a factor "m" and the factors "n" and "m" are related to the factor "$\gamma$" by the condition that both "n" and "m" are greater than "$\gamma$".

17. The current level reference of claim 16 further comprising a current sink transistor having tenth, eleventh, and twelfth terminals, said tenth terminal being coupled to said second voltage potential and said twelfth terminal being coupled to said second terminal of said second transistor, whereby said eleventh terminal will sink a level of current controlled by the level of current passed by said second transistor.

18. The current level reference of claim 17 wherein said first voltage potential is negative with respect to said second voltage potential, said third transistor is coupled to said first transistor through a seventh transistor and said fourth transistor is coupled to said second transistor through an eighth transistor, said current level reference further comprising biasing means, coupled to said seventh and eighth transistors, for clamping the maximum voltage potential across said first and second transistors to a predetermined level.

19. Apparatus for providing a precision reference current level, said apparatus comprising:

(a) first means for providing first and second current paths for the transfer of current, said first means establishing a proportional relationship between the levels of current transferred through said first and second current paths;

(b) second means, coupled to said first and second current paths, for creating a first voltage difference between a first point in said first current path and a second point in said second current path, said second means including a first transistor provided in said first current path and coupled to said first point for creating a first current density defined voltage drop, and a second transistor provided in said second current path and coupled to said second point for creating a second current density defined voltage drop, said first voltage difference being the difference between said first and second current density defined voltage drops; and (c) third means, coupled to said first and second current paths, for creating a second voltage difference between said first point in said first current path and said second point in said second current path, said third means including a third transistor provided in said first current path and coupled to said first point for creating a third current density defined voltage drop, and a fourth transistor provided in said second current path and coupled to said second point for creating a fourth current density defined voltage drop, said second voltage difference being the difference between said third and fourth current density defined voltage drops, wherein the levels of current transferred through said first and second current paths tend to respective discrete levels such that said first and second voltage differences are of complementary polarity and common, non-zero magnitude.

20. The apparatus of claim 19 wherein said first and second transistors are of a first type and said third and fourth transistors of a second type.

21. The apparatus of claim 20 wherein the active current conducting area of said second and fourth transistors are scaled with respect to that of said first and third transistors to establish current density to voltage drop relationships of said first, second, third and fourth transistors.

22. The apparatus of claim 20 wherein transistors of said first type have a complementary temperature coefficient with respect to transistors of said second type.

23. The apparatus of claim 22 further comprising means, coupled to said first means so as to be responsive to the level of current being transferred there through, for sourcing current at a level proportional to the current level through said first current path.

24. The apparatus of claim 23 wherein said first and second transistors are field effect transistors and wherein said third and fourth transistors are bipolar transistors.

* * * * *

UNITED STATES PATENT AND TRADEMARK OFFICE

CERTIFICATE OF CORRECTION

PATENT NO. : 4,792,750

DATED : December 20, 1988

INVENTOR(S) : Raymond C. Yan

It is certified that error appears in the above-identified patent and that said Letters Patent is hereby corrected as shown below:

Column 9, line 38,

"$\Delta (V_{TP1}-V_{TP2})$: 5mV pl $(V_{TP1}-V_{TP2})$: 25mV" should be

--$\Delta (V_{TP1}-V_{TP2})$: 5mV $(V_{TP1}-V_{TP2})$: 25mV --

Signed and Sealed this

Nineteenth Day of September, 1989

*Attest:*

*Attesting Officer*

DONALD J. QUIGG

*Commissioner of Patents and Trademarks*